US005162807A

United States Patent [19]

Ursenbach et al.

[11] Patent Number: 5,162,807

[45] Date of Patent: Nov. 10, 1992

[54] ARCHITECTURAL STRUCTURE COMBINING AT LEAST ONE ANTENNA WITH SUPPORTING MAST POSITIONED ON THE GROUND AND AT LEAST ONE HIGH-POWER TRANSMITTER

[75] Inventors: Francois Ursenbach, Eaubonne; Jean-Marc Martin, St Leu la Foret, both of France

[73] Assignee: Thomson-CSF, Puteaux, France

[21] Appl. No.: 627,355

[22] Filed: Dec. 14, 1990

[30] Foreign Application Priority Data

Dec. 22, 1989 [FR] France ..... 89 17085

[51] Int. Cl.[5] ..... H01Q 3/00

[52] U.S. Cl. ..... 343/763; 343/890

[58] Field of Search ..... 343/763, 882, 890, 891, 343/874, 757

[56] References Cited

U.S. PATENT DOCUMENTS

| | | | |
|---|---|---|---|
| 1,206,353 | 11/1916 | Millener | 343/890 |
| 2,229,733 | 1/1941 | Goldmann | 343/820 |
| 2,497,065 | 2/1950 | Braddon | 343/890 |
| 2,668,191 | 2/1954 | Cohn | 343/763 |
| 2,744,704 | 5/1956 | Johnson | 343/763 |
| 3,768,016 | 10/1973 | Townsend et al. | 343/879 |

FOREIGN PATENT DOCUMENTS

| | | |
|---|---|---|
| 3812270 | 4/1988 | Fed. Rep. of Germany . |
| 207592 | 3/1984 | German Democratic Rep. . |
| 510807 | 9/1971 | Switzerland . |

*Primary Examiner*—Rolf Hille
*Assistant Examiner*—Hoanganh Le
*Attorney, Agent, or Firm*—Oblon, Spivak, McClelland, Maier & Neustadt

[57] ABSTRACT

The disclosure concerns an assembly formed by a large-sized antenna with a supporting mast, the working of which brings the ground plane into play, and by a high-power transmitter. To reduce the distance between the transmitter and the radiating part of the antenna, and to reduce the cost of the architectural structure of the antenna and of the room sheltering the transmitter, this room is formed by the base of the mast which supports the antenna. The dimensions and bed of the base of the mast are designed as a function of the space needed and of the stability to be given to the antenna.

3 Claims, 3 Drawing Sheets

~~ART ANTERIEUR~~ PRIOR ART

ARCHITECTURAL STRUCTURE COMBINING AT LEAST ONE ANTENNA WITH SUPPORTING MAST POSITIONED ON THE GROUND AND AT LEAST ONE HIGH-POWER TRANSMITTER

BACKGROUND OF THE INVENTION

1. Field of the Invention

The present invention concerns the combination formed by a high-power transmitter and an antenna with a supporting mast connected to this antenna. More particularly, it relates to the architecture of the antenna and of the room in which the transmitter is sheltered.

When a high-power (hence large-sized) transmitter is associated with an antenna with a supporting mast, for example when it is associated with a dipole sheet rotating antenna, considerations pertaining to ease of construction and reduction of losses in the power transmission lines generally lead to building the room that shelters the transmitter very close to the base of the antenna. This is especially so in short-wave (3 to 30 MHz) radio broadcasting.

SUMMARY OF THE INVENTION

An aim of the present invention is to reduce the construction costs of the assembly formed by a large antenna with a supporting mast and the high-power transistor with which it is associated.

This is obtained by integrating the transmitter into the base of the antenna mast.

According to the invention, there is provided an architectural structure combining an antenna with a supporting mast, positioned on the ground, and at least one high-power transmitter positioned the mast.

BRIEF DESCRIPTION OF THE DRAWINGS

The present invention will be understood more clearly, and other characteristics will appear from the following description and from the figures pertaining thereto. Of these figures.

In the different figures, the same references are repeated for the corresponding elements.

MORE DETAILED DESCRIPTION

Figure 1:
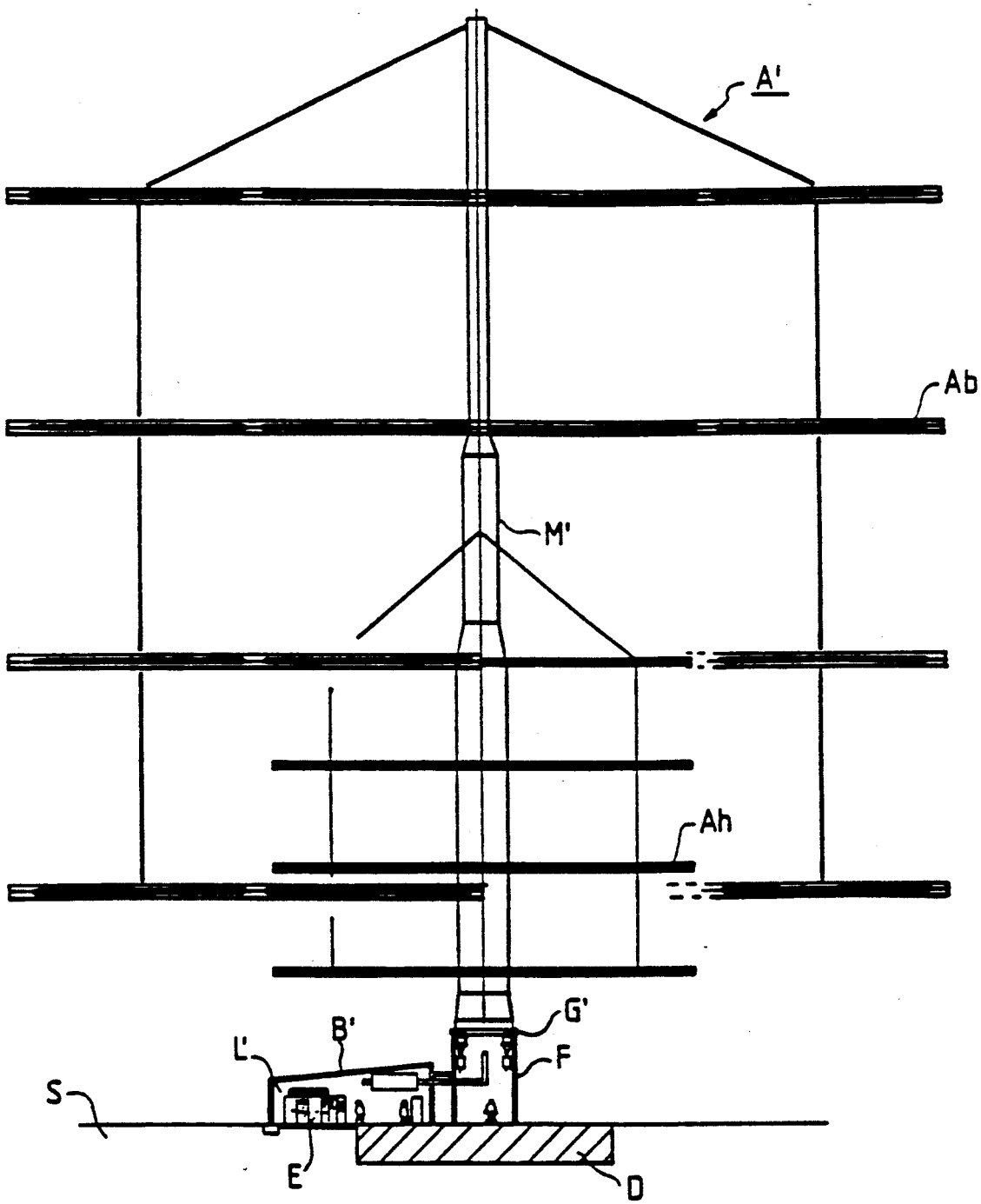
FIG. 1 shows a prior art assembly made up of an antenna and a transmitter.

FIG. 1 is a schematic sectional view that shows the architecture of an assembly consisting of an antenna A' and a transmission room L' in which a 500 kW transmitter E is set up with auxiliary circuits such as, for example, a balun. Three human figures are shown in FIG. 1 in order to enable the dimensions to be estimated by comparison.

The antenna A' is a rotating antenna with a mast M'. This antenna is a double antenna formed by two antennas proper: a low-frequency antenna Ab, of the HR 4/4/.5 - 6/11 MHz type (i.e. of the type having horizontal dipole sheets, H, with reflector R, with two full wave dipoles per line and per column, namely the equivalent of four half-wave dipoles per line and per column, wherein the height of the first dipoles with respect to the ground is equal to 0.5 times the mean operating wavelength, the antenna being designed to work in the 6, 7, 9 and 11 MHz bands) and a high-frequency antenna Ah, of the HR 4/4/.73 - 13/26 MHz type. The low-frequency antenna, Ab, has not been fully depicted in order to make it easier to see the high-frequency antenna, Ah, which is in a plane parallel to its own plane but towards the rear in the view of FIG. 1. A reflecting sheet, formed by horizontal metal wires positioned in a vertical plane located between the planes of the sheets of dipoles of the antennas Ab and Ah, has not been depicted to avoid burdening the figure.

By means of horizontal arms (not shown) and stays, the mast M' acts as a support for the sheets of dipoles and the reflecting sheet. It includes a top part, formed by metal tubes, and a bottom part, or base, on which the top part is supported. This base is formed by a vertical metal shaft F, the top end of which is coupled to the rest of the mast by a mechanical assembly G' comprising a ring gear driven by a mechanism with electrical motors.

The shaft F is fixed to a reinforced concrete slab D, cast into a ditch dug out of the ground S.

The transmission room L' is positioned just beside the shaft F, to which it is coupled by electrical and mechanical links.

It must be noted that the room L' is covered with a shielding B' connected to earth and connected to ground the antenna mast when this room is made masonry. All the same, the fact remains that the room L' is a disturbing factor in the electromagnetic environment of the antenna A', the working of which depends on the ground plane.

In the embodiment described by means of FIG. 1, the reinforced concrete slab D forms a sort of cross constituted by two bars, each of which is about 20 meters long by 5 meters wide and three meters thick, and the upper face of this cross is flush with the level of the ground and forms the floor of the interior of the shaft of the antenna and a part of the floor of the room L'.

Figure 2:
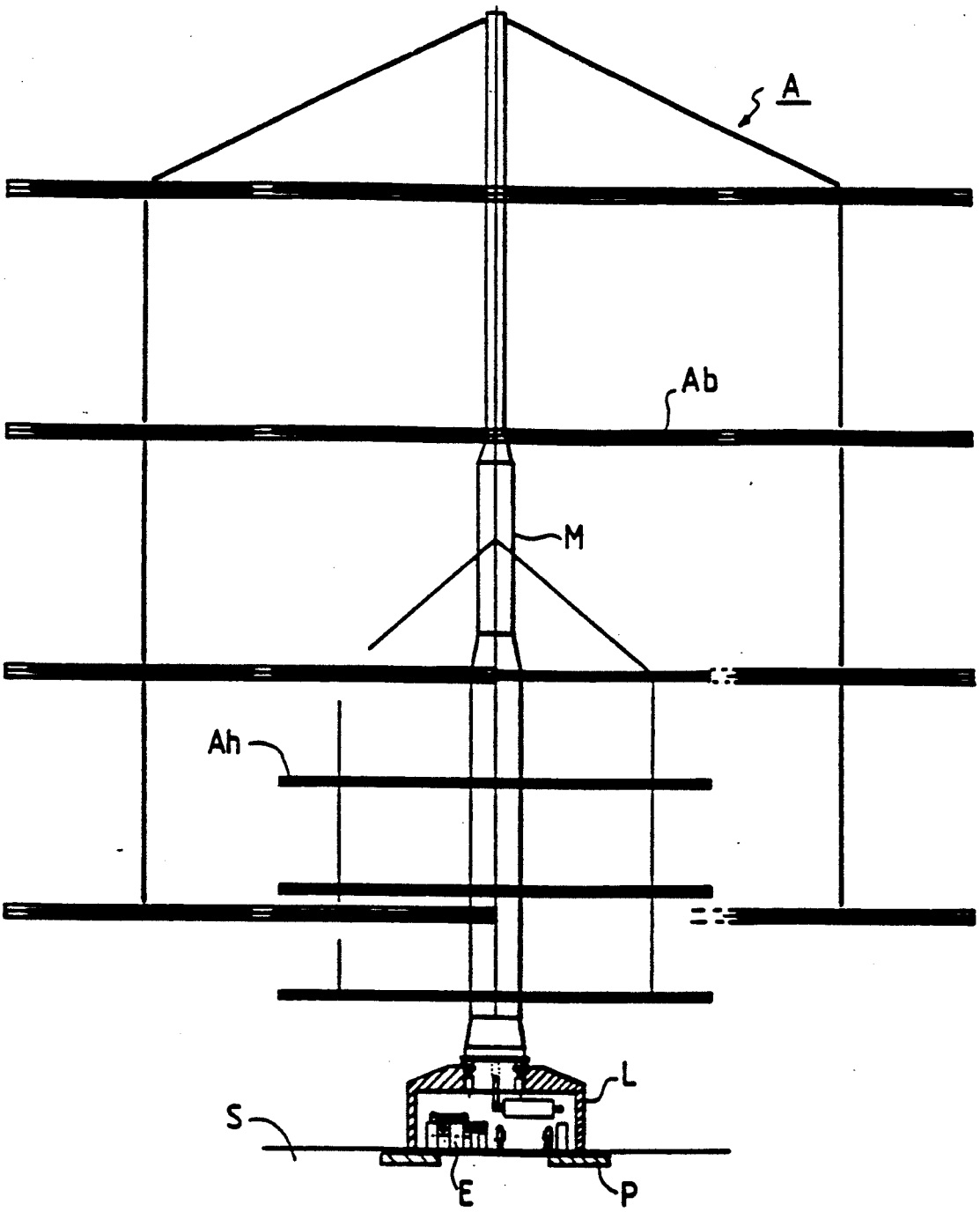
FIG. 2 shows an assembly according to the invention, made up of an antenna and a transmitter.

FIG. 2 shows a schematic sectional view of an assembly including a transmitter E identical to the transmitter E referred to in the description of FIG. 1, and an antenna A for which the sheets of dipoles Ab, Ah and the reflective sheet, not shown, are identical to those of the antenna A' of FIG. 1. The assembly according to FIG. 2 differs essentially from the one according t FIG. 1 by the fact that the antenna includes a mast M, the base of which is substantially bulkier than the base of the mast M'. Indeed, the base of the mast M constitutes a room L. This room is formed by a square-shaped enclosure and four supporting plates, such as the plate P, on which the enclosure lies. The square-shaped enclosure, which shelters the transmitter E and its auxiliary circuits, is centered beneath the top part of the mast M and is located off the ground S, while the four plates are in the ground. The room is made of reinforced concrete. The supporting plates are first of all cast into holes hollowed out in the ground and positioned so as to be evenly distributed beneath the position of the enclosure. Iron bars held in the concrete of the supporting plates and in that of the walls of the enclosure, provide for the transmission, from the room towards the ground, of the forces constituted by the vertical loads, the shearing forces and the moment of tilt.

The base of the plates, combined with the total weight of the antenna, gives the structural unit formed by the antenna its stability.

Figure 3:
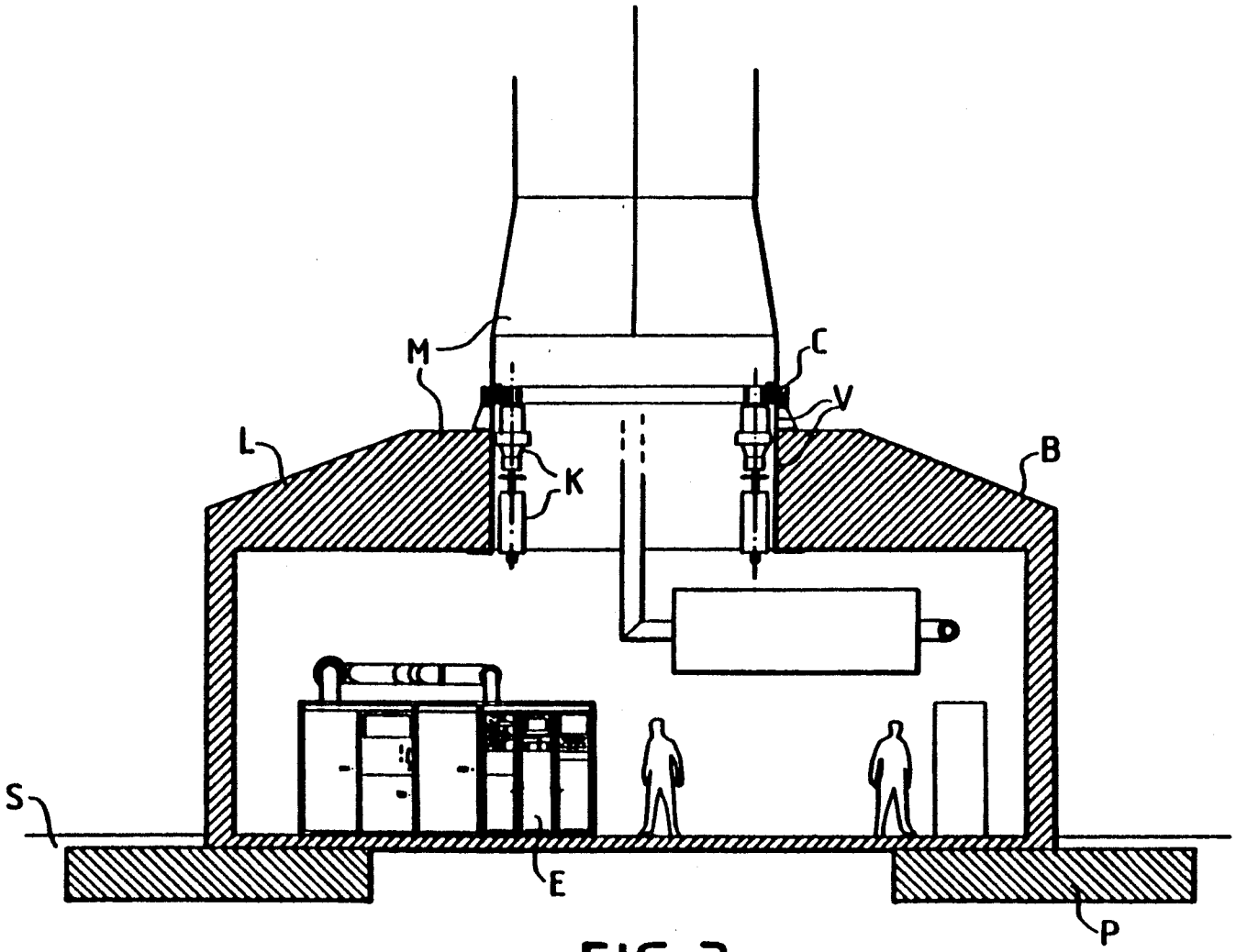
FIG. 3 shows a more detailed view of the assembly according to FIG. 2.

FIG. 3 gives a more detailed view of the architecture of the room L of FIG. 2, and hence of the bottom of the antenna A. The room has an internal volume formed by a diameter of 4.4 meters by a height of 4.5 meters. The ceiling of the room is pierced, at its center, with a vertical cylindrical aperture having a diameter of 4.4 meters, and the thickness of the ceiling varies from 0.6 meters at the periphery to 1.8 meters on the edge of the cylindrical hole. The aperture is lined with a metal collar V sealed into the concrete. This collar supports a ring gear C which enables the top part of the mast M to be rotated under the action of a driving mechanism K fitted out with electrical motors. The collar V, the ring gear K and the mechanism K constitute a mechanical assembly G similar to the assembly G' of FIG. 1 except that, in the embodiment according to FIG. 1 the collar is constituted by the upper part of the shaft F while, in the embodiment according to FIG. 2, the collar forms a sort of ring. This embodiment, in which the ring is surrounded by concrete, greatly stiffens the collar V and prevents any bending which would be detrimental to the efficient working of the ring gear C.

A shielding B, which overlaps the external walls of the rool L and is connected to the ground, makes the interior of the room highly immune to the fields that the antenna produces beneath itself.

Through the space that it provides, the embodiment according to FIGS. 2 and 3 facilitates the installation of the driving mechanism K. It also makes it possible, for example in hot climates, to achieve the total air conditioning of all the sensitive elements, including the ring gear C and the mechanism K, by means of a single air conditioning installation acting in a single volume.

Should the supporting plates such as P be insufficient to ensure the stability of the antenna, i.e., for example if the ground is not hard enough, reinforcements such as piles could be added on to the structure of the room.

The invention is not restricted to the examples described. It is thus, in particular, that the transmitter E and its circuits may be positioned in the rotating part of the antenna.

In the same way, in the embodiments according to FIGS. 2 and 3, the place available in the room makes it possible for several transmitters, for example two transmitters, to be housed therein. These transmitters could work in a coupled mode or as back-up transmitters for one another.

The present invention can be applied to all architectural structures, whether rotating or fixed, which combine an antenna with a supporting mast positioned on the ground and at least one high-power transmitter connected to the antenna. The term "high-power" transmitter is understood to mean a transmitter with power of at least 100 kW.

It should also be noted that the shape of the section of the enclosure may be other than square. In particular it may be round.

What is claimed is:

1. An architectural structure comprising:

a shortwave antenna;

a mast for supporting said short wave antenna, wherein said mast has a base which forms a room, said base being secured to ground;

at least one transmitter positioned inside said room of the base of the mast;

wherein said mast further comprises a movable structure positioned above said base and coupled to said base by a coupling structure, and said short wave antenna is a rotating short wave antenna mounted to said movable structure; and wherein the room has a ceiling pierced with an aperture and wherein the coupling structure comprises a collar lining the aperture of said room, a ring gear formed above said collar and a driving mechanism for driving said ring gear to thereby rotate the rotating short wave antenna.

2. An architectural structure comprising:

a short wave antenna;

a mast for supporting said short wave antenna, wherein said mast has a base which forms a room, said base being secured to ground;

at least one transmitter positioned inside said room of the base of the mast;

wherein the room is made of reinforced concrete and includes supporting plates made of concrete, cast into the ground, and a concrete chamber, resting at ground level, on the supporting plates to which it is fixed.

3. A structure according to claim 2, wherein the room has walls lined with a shielding.

* * * * *